US005748096A

United States Patent [19]

Kaufer

[11] Patent Number: 5,748,096

[45] Date of Patent: May 5, 1998

[54] TOILET BOWL ILLUMINATION DEVICE INCLUDING AUDIBLE ANNUNCIATOR FOR REMINDING USER TO MOVE TOILET SEAT FROM UPPER RETRACTED POSITION TO LOWER SEATING POSITION AFTER USE

[76] Inventor: Laurel G. Kaufer, 24267 Martha St., Woodland Hills, Calif. 91367

[21] Appl. No.: 752,214

[22] Filed: Nov. 19, 1996

[51] Int. Cl.[6] ..... G08B 21/00

[52] U.S. Cl. ..... 340/686; 340/573; 340/692; 4/235; 4/661

[58] Field of Search ..... 340/686, 573, 340/692; 4/235, 661

[56] References Cited

U.S. PATENT DOCUMENTS

| | | | |
|---|---|---|---|
| 4,413,364 | 11/1983 | Bittaker et al. | 4/661 |
| 4,491,991 | 1/1985 | Herbruck | 4/661 |
| 4,733,419 | 3/1988 | Nee | 4/661 |
| 4,736,471 | 4/1988 | Johnson | 4/234 |
| 4,849,742 | 7/1989 | Warrington | 340/686 |
| 4,860,178 | 8/1989 | Picon | 362/101 |
| 5,003,648 | 4/1991 | Anderson | 4/661 |
| 5,136,476 | 8/1992 | Horn | 362/198 |
| 5,150,962 | 9/1992 | Rauschenberger | 362/101 |
| 5,263,209 | 11/1993 | Pattee | 4/661 |
| 5,276,595 | 1/1994 | Patrie | 362/101 |
| 5,384,917 | 1/1995 | Epling | 4/235 |
| 5,437,066 | 8/1995 | Mills et al. | 4/661 |
| 5,489,893 | 2/1996 | Jo et al. | 340/686 |
| 5,499,008 | 3/1996 | Rosenkrantz et al. | 4/661 |
| 5,513,397 | 5/1996 | Terry | 4/661 |

*Primary Examiner*—Jeffery Hofsass
*Assistant Examiner*—Benjamin C. Lee
*Attorney, Agent, or Firm*—Bronson, Bronson & McKinnon

[57] ABSTRACT

An illuminating and annunciating device for a toilet having a bowl, and a seat which is movable between a lower seating position and an upper retracted position, includes an illumination unit for illuminating the bowl for nighttime standing urination. An annunciator unit generates an audible indication which reminds a user to move the seat from the retracted position to the seating position after use. A sensor activates the illumination unit and the annunciator unit when the seat is in the retracted position, and de-activates the illumination unit and the annunciator unit when the seat is in the seating position. The device is attached to the toilet seat or bowl, and the sensor includes a switch which is actuated by the other of the toilet seat or bowl when the seat is in the seating position. The annunciator unit preferably includes an audio module with a recording and playback capability for recording the audible indication as a verbal message, musical sequence, etc. and playing back the indication when the seat is retracted.

16 Claims, 4 Drawing Sheets

TOILET BOWL ILLUMINATION DEVICE INCLUDING AUDIBLE ANNUNCIATOR FOR REMINDING USER TO MOVE TOILET SEAT FROM UPPER RETRACTED POSITION TO LOWER SEATING POSITION AFTER USE

BACKGROUND OF THE INVENTION

1. Field of the Invention

The present invention generally relates to the nighttime use of toilet facilities, and more specifically to a toilet bowl illumination device including an audible annunciator for reminding a user to move a toilet seat from an upper retracted position to a lower seating position after use.

2. Description of the Related Art

A conventional residential toilet generally includes a bowl, and a seat which is movable between a lower seating position and an upper retracted position. The seating position is used by both male and female household members, whereas the retracted position is for standing male urination.

The safe and comfortable use of the toilet is facilitated when the seat is left down at all times when the toilet is not in use, and this is a form of etiquette in many families.

A small child or even an adult can fall down into the toilet bowl if attempting to sit on the seat when it is actually up. This hazard is especially present at night if a user is drowsy and the main bathroom light is not turned on.

It is relatively difficult to miss the toilet bowl when performing urination while sitting on the seat. However, male urination is conventionally performed from a standing position with the toilet seat up.

If a male user is sufficiently drowsy and/or disoriented by lack of light, he can miss the interior of the toilet bowl, and splatter the exterior of the toilet or even the floor. It is even possible to forget to raise the seat before performing standing urination.

Various expedients have been proposed in the prior art for attempting to forestall these contingencies. U.S. Pat. No. 5,150,962 to Rauschenberger, for example, discloses an illuminating device which is mounted on a toilet bowl. The device includes a lamp for illuminating the interior of the bowl, and a switch which is actuated by the seat such that the lamp is energized when the seat is up, and de-energized when the seat is down.

A more extensive arrangement is disclosed in U.S. Pat. No. 5,276,595 to Patrie, in which a device is mounted on a toilet seat lid for bowl illumination. A proximity sensor activates the device when a user approaches the toilet. The device illuminates the bowl with light of a first color when the seat is up, and with a second color when the seat is down. If the seat is up when the user approaches, the device further energizes an audible chime for a brief period of time.

Although the Rauschenberger and Patrie devices address the problems of lack of toilet bowl illumination and determination of whether the seat is up or down for nighttime use, they do not provide any capability for prompting a user to lower the seat after performing standing urination so that the seat will be in the desirable lower position for a subsequent user. It can be common for a male user to fail to return the seat to the lower position at night due to drowsiness or carelessness.

Although the Patrie device includes a chime, it is specifically configured such that the chime will not sound when a user raises the seat. This is the preferred scenario in which the seat is normally down, and is raised by a user for standing urination. The Patrie device is further disadvantageous in that it is protrudes from the toilet lid, and can cause discomfort or injury if a sitting user backs into the device.

Furthermore, since these devices are powered by batteries, accidently leaving the devices on continuously by failing to lower the seat after use will rapidly discharge the batteries and render the devices inoperative.

In view of the above, a pressing need exists in the art for a toilet bowl illumination device which includes a capability for prompting a user to lower a toilet seat after use.

SUMMARY OF THE INVENTION

The above described need which has existed heretofore in the prior art is fulfilled in accordance with the present invention.

More specifically, an illuminating and annunciating device embodying the present invention is provided for a toilet having a bowl, and a seat which is movable between a lower seating position and an upper retracted position. The device includes an illumination unit for illuminating the bowl for nighttime standing urination.

An annunciator unit generates an audible indication which reminds a user to move the seat from the retracted position to the seating position after use. A sensor activates the illumination unit and the annunciator unit when the seat is in the retracted position, and de-activates the illumination unit and the annunciator unit when the seat is in the seating position. The device is attached to the toilet seat or bowl, and the sensor includes a switch which is actuated by the other of the toilet seat or bowl when the seat is in the seating position.

The annunciator unit preferably includes an audio module with a recording and playback capability for recording the audible indication as a verbal message, musical sequence, etc. and playing back the indication when the seat is retracted.

The present invention further improves over the prior art in that it provides a reminder to lower the seat after use in the daytime, as well as night.

These and other features and advantages of the present invention will be apparent to those skilled in the art from the following detailed description, taken together with the accompanying drawings, in which like reference numerals refer to like parts.

DETAILED DESCRIPTION OF THE INVENTION

Figure 1:
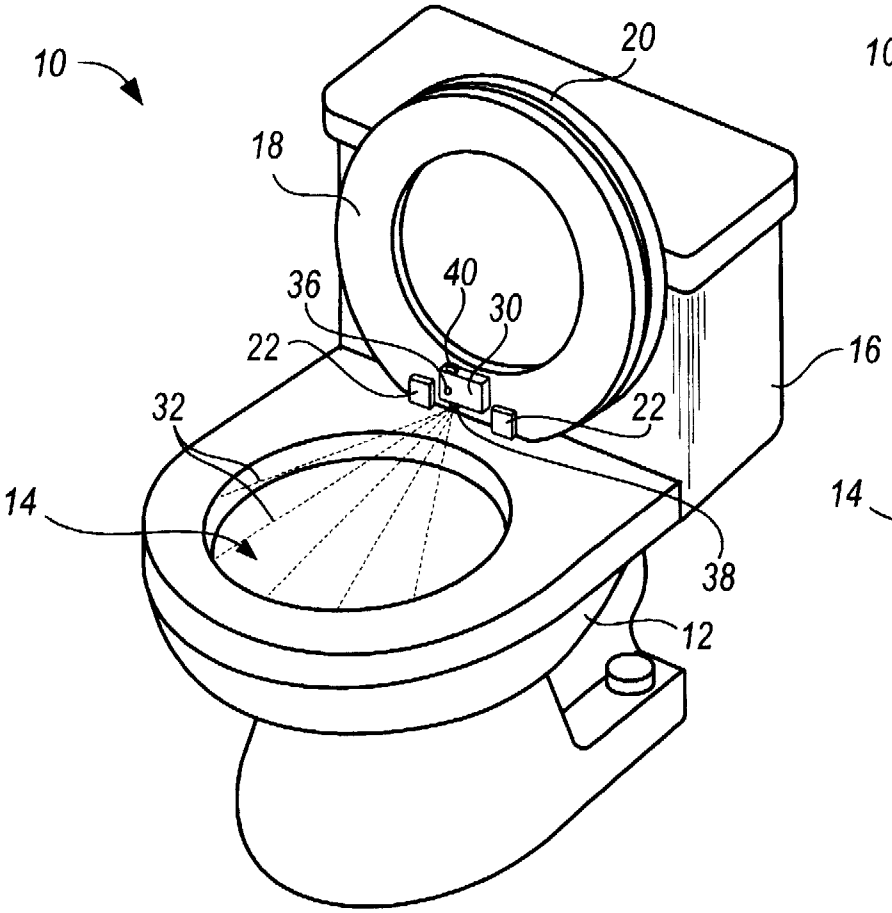
FIG. 1 is a perspective view illustrating a conventional residential toilet which is provided with a first embodiment of an illumination and annunciating device according to the present invention.

A first embodiment of the present invention is illustrated in FIG. 1. A conventional residential toilet is generally designated by the reference numeral 10, and comprises a body 12 which defines a bowl 14. A water closet 16 is mounted on the body 12 to provide flushing water for the bowl 14 in a well known manner.

The toilet 10 further comprises a seat 18 and a lid 20 which are attached to the upper rear portion of the body 12 by a hinge arrangement 22. The seat 18 is movable between an upper retracted position as illustrated in FIG. 1 for standing urination, and a lower seating position for other uses. The lid 20 can be lowered from the illustrated retracted position to a lower position to cover the seat 18 when the seat 18 is down.

In accordance with the present invention, an illumination and annunciator device 30 is attached to the lower (front as viewed in FIG. 1) surface of the seat 18. When the seat 18 is up as shown, the device 30 illuminates the interior of the bowl 14 with preferably a gentle green light as indicated by rays 32.

Figure 2:
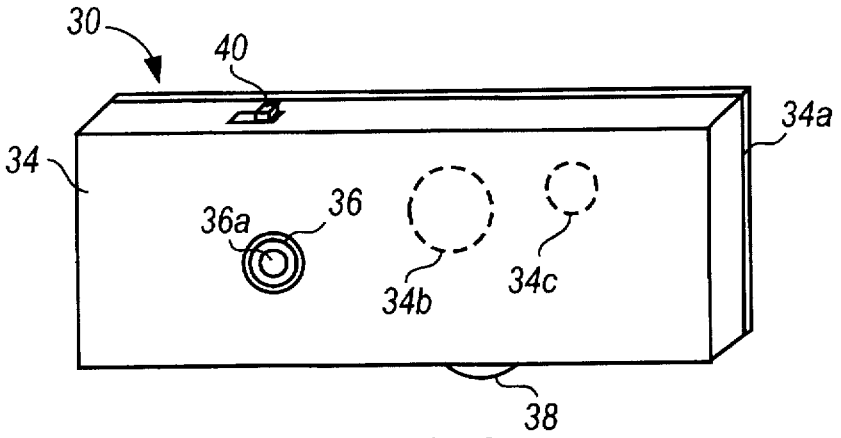
FIG. 2 is a front perspective view of the device of FIG. 1.

The device 30 is further illustrated in FIG. 2, and comprises a casing 34 having a rear cover 34 *a* which is attached to the main body of the casing 34 by screws or the like (not shown). A plunger 36 *a* of a sensor switch 36, and a lamp which is preferably a green Light Emitting Diode (LED) 38, protrude from the casing 34. The LED 38 produces the rays 32 for illuminating the bowl 14 when the seat 18 is up. Further visible in FIGS. 1 and 2 is a slide switch 40 for switching between a record mode and a playback mode as will be described in detail below.

The switch 36 is actuated by lowering the seat 18 such that the plunger 36*a* is depressed by engagement with an upper rear surface of the body 12 which constitutes an edge of the bowl 14. More specifically, when the seat 18 is up, the plunger 36*a* does not engage the bowl 14, and the LED 38 is activated to illuminate the interior of the bowl 14. When the seat 18 is lowered into the seating position, the plunger 36*a* engages with the bowl 14 and is depressed thereby, and the LED 38 is de-activated such that bowl 14 is not illuminated.

Figure 3:
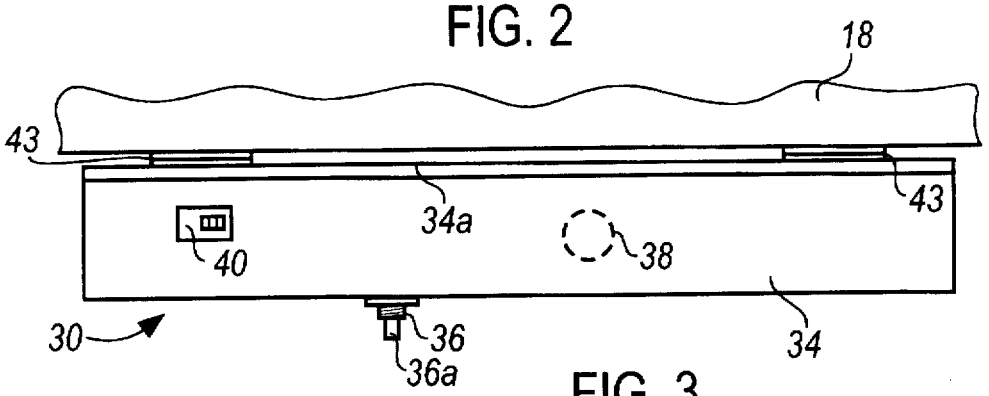
FIG. 3 is a top view of the device of FIG. 1.

FIG. 3 illustrates the seat 18 and device 30 in the lowered seating position. The device 30 is attached to the seat 18 using velcro strips 43, adhesive, or other suitable means. Preferably, the casing 34 is liquid resistingly sealed to preclude contamination and/or short circuiting of internal electrical components. This also enables the device 30 to be removed from the seat 18 and washed if necessary to remove any contaminants which may have become splattered thereon. The casing 34 can be sealed by O-rings, flexible webs, or any other known means although not explicitly illustrated.

With the construction described thus far, when the seat 18 is raised to the position illustrated in FIG. 1 for standing urination, the bowl 14 is illuminated by the LED 38. When the seat 18 is lowered for seated use or as a courtesy to subsequent users, the LED 38 is turned off. In addition to this capability, the present device 30 comprises an annunciation mechanism which audibly prompts a user to return the seat 18 to the lower position after use.

Figure 4:
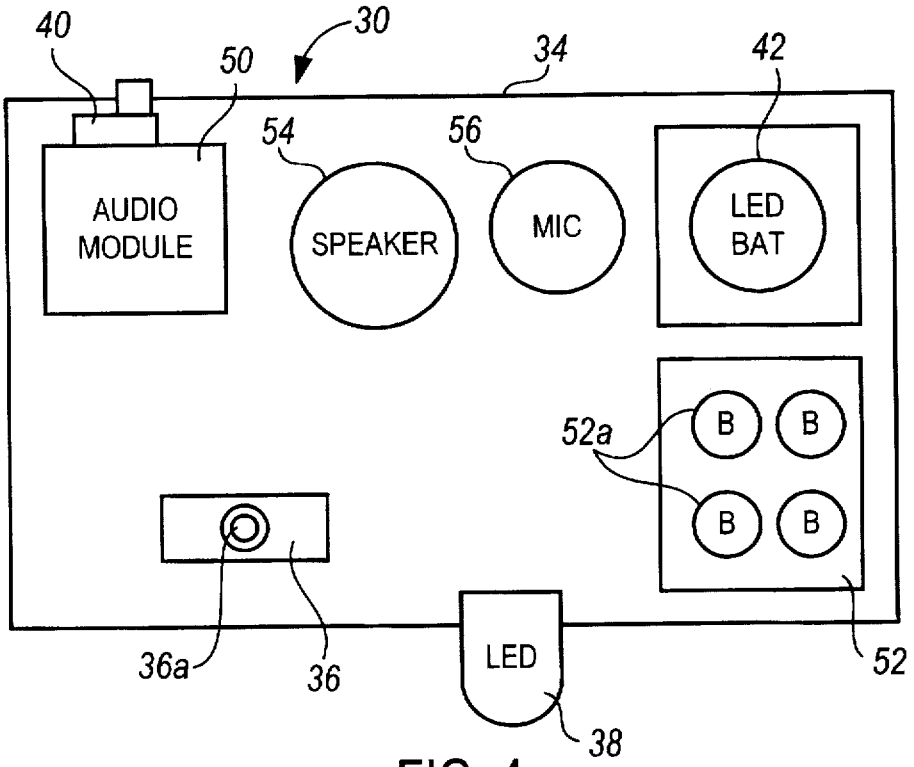
FIG. 4 is a diagram illustrating the layout of internal components of the device of FIG. 1.
Figure 5:
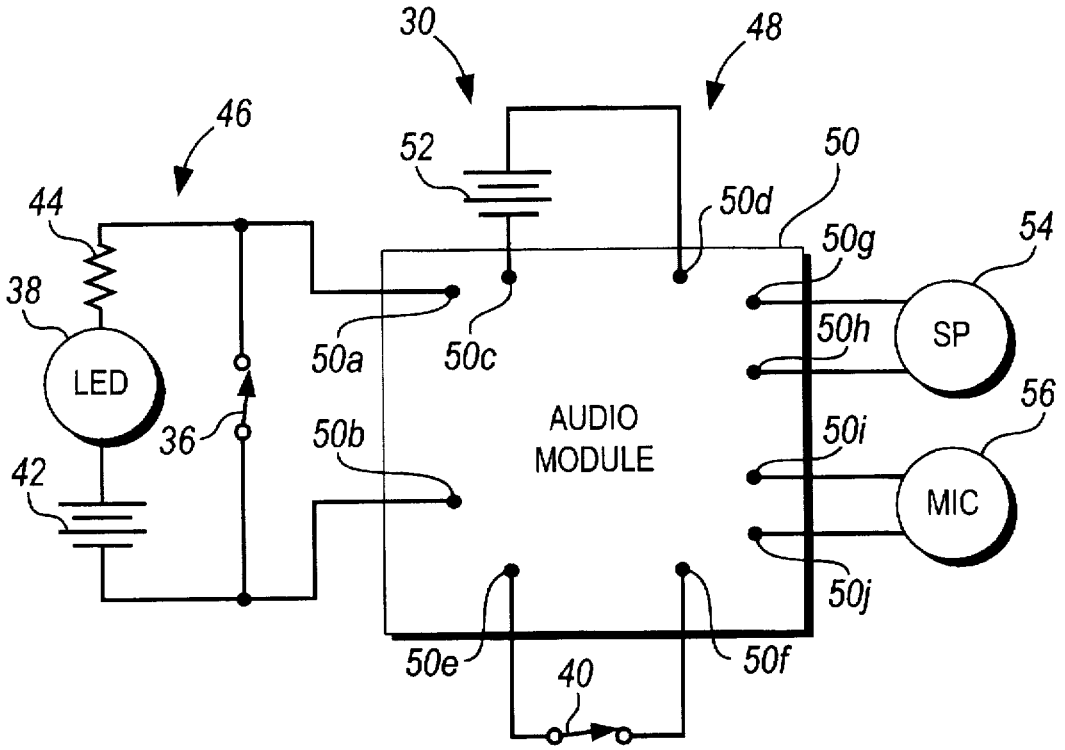
FIG. 5 is an electrical schematic diagram of the device of FIG. 1.

FIGS. 4 and 5 in combination illustrate the electrical components of the device 30, and the manner in which they perform the present functionality.

The device 30 includes a battery 42 which provides a voltage in the range of, for example, 1.5 to 9 volts, for powering the LED 30. The switch 36, LED 38 and battery 42 are connected in series with a current limiting resistor 44 which may or may not be necessary depending on the current rating of the LED 42. Preferably, the battery 42 is a flat disk type to enable the device 30 to be made thin enough to fit in the space between the seat 18 and the bowl 14 when the seat 18 is down. These elements constitute an illumination unit 46 of the device 30.

The switch 36 is normally closed to complete the circuit between the battery 42 and LED 38 when the seat 18 is up, and is opened by depression of the plunger 36*a* when the seat 18 is down.

An annunciator unit 48 of the device 30 comprises an audio module 50 having ON/OFF terminals 50*a*, 50*b* which are connected across the switch 36. When the switch 36 is closed (seat 18 is up), the switch 36 connects the terminals 50*a*, 50*b* together to activate or turn on the audio module 50. When the switch 36 is opened (seat 18 is down), the terminals 50*a*, 50*b* are disconnected and the audio module 50 is de-activated or turned off.

The audio module 50 is powered by one or more batteries. As illustrated in FIG. 4, a battery unit 52 includes four flat disk batteries 52*a* which are connected in series. Typically, the individual batteries 52*a* each produce 1.5 volts, and the battery unit 52 thereby applies 6 volts to the module 50 via power terminals 50*c*, 50*d*.

The switch 40 is connected to mode select terminals 50*e*, 50*f* of the module 50. When the switch 40 is open, the module 50 is in one of a record mode or a playback mode, and when the switch 42 is closed, the module 50 is in the other of the record mode or playback mode.

The annunciator unit 48 further includes a speaker 54 which is connected to the module 50 via speaker terminals 50*g*, 50*h*, and a microphone 56 which is connected to the module 50 via microphone terminals 50*i*, 50*j*. The microphone 56 enables the owner of the device 30 to record an audio sequence in the module 50, whereas the speaker 54 produces an audible annunciation consisting of the audio sequence as played back.

As viewed in FIG. 2, the back cover 36 may be formed with holes 34*b* and 34*c* which enable the speaker 54 and microphone 56 to respectively communicate directly with the space external of the casing 34 in a liquid resistant manner.

Electrical components which can implement the functionality of the audio module 50 and associated elements are commercially available as off-the-shelf items. For example, a digital voice record/playback kit is available from Radio Shack as part no. 276-1326 which includes all necessary items except the battery unit 52.

In operation, the owner uses the switch 40 to select record mode, and records an audio sequence in an internal memory of the module 50 via the microphone 56. The module 50 has a capacity to store a message having a maximum time length of, for example, 20 seconds. After recording the audio sequence, the owner uses the switch 40 to select playback mode, and attaches the device 30 to the toilet seat 18.

The audio sequence is long enough to prompt a drowsy person to return the seat 18 to the lower position after using the toilet 10 for standing urination. A minimum time length of 20 seconds (which is the maximum capacity of the above referenced Radio Shack unit) is considered to be appropriate, although the invention is not so limited. It is further within the scope of the invention to produce an audio module 50 which repeatedly plays back an audio sequence as an endless loop (like a tape loop), or which continuously generates an audio sequence such as musical tones.

The audio sequence which the owner records in the module 50 can be a verbal message (preferably entertaining and/or humorous), a musical selection, or any other sequence of audio tones which is intended to prompt a user to put down the toilet seat 18 after use. The fact that the content of the audio sequence is completely flexible makes the device 30 especially desirable as a gift or novelty item.

For some toilets, the spacing between the bowl 14 and the seat 18 may be too small for the device 30 to normally fit therebetween. For this reason, a plurality of shims (not shown) made of plastic or other suitable material may be supplied with the device 30 to raise the seat 18 relative to the bowl 14. The shims are formed with holes through which bolts (not shown) that extend from the hinge assembly 22 and connect the seat 18 and lid 20 to the body 12 extend.

The shims are installed by removing the seat 18 and lid 20 from the body 12, assembling the shims onto the bolts, and re-attaching the seat 18 and lid 20 to the body 12 such that the shims are disposed between the hinge assembly 22 and the body 12 to elevate the seat 18 and lid 20.

A sufficiently large number of shims are provided such that a person installing the device 30 can adjust the seat 18 to a suitable height which enables the device 30 to fit between the bowl 14 and seat 18 with the plunger **36*a* being properly actuated via engagement with the rim of the bowl 14 by selecting a corresponding number of shims. The shims may also be provided with one or two adhesive surfaces to prevent slipping of the seat 18 relative to the bowl 14**.

Figure 6:
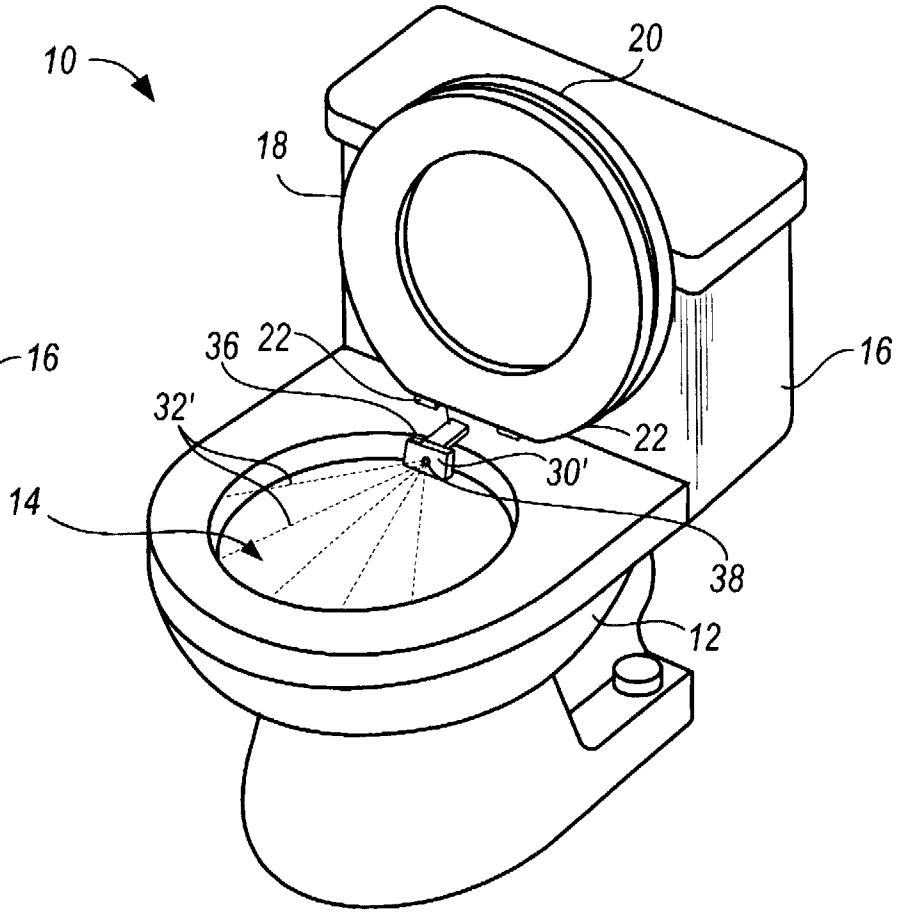
FIG. 6 is a perspective view illustrating a conventional residential toilet which is provided with a second embodiment of an illumination and annunciating device according to the present invention.
Figure 7:
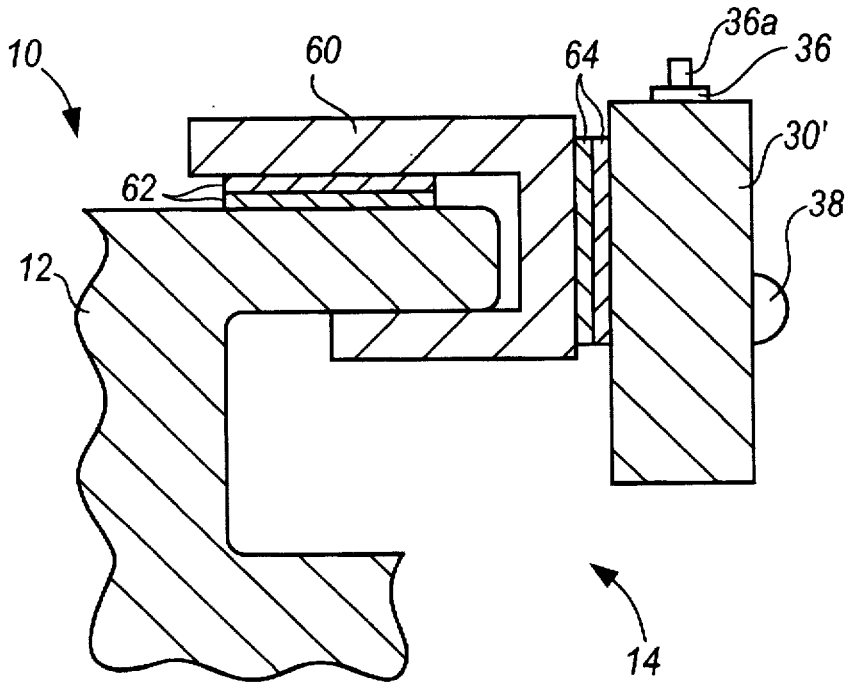
FIG. 7 is a sectional elevation illustrating the toilet and device of FIG. 6.
Figure 8:
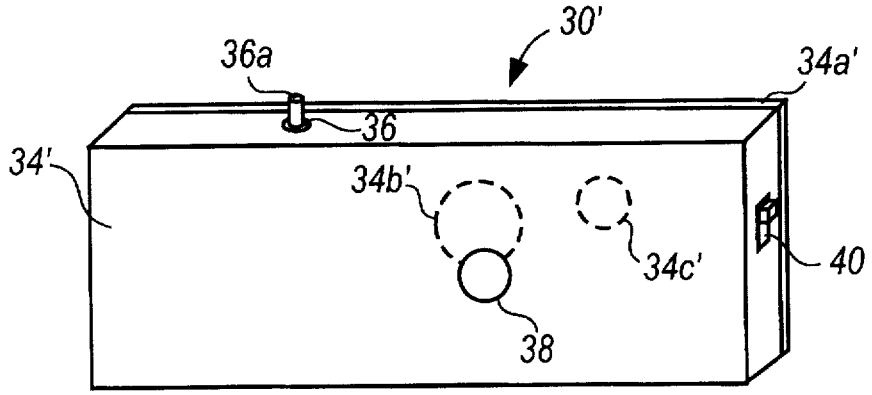
FIG. 8 is a front perspective view of the device of FIG. 6.

FIGS. 6 to 8 illustrate a second illumination and annunciator device 30' embodying the present invention, in which like numerals are designated by the same reference numerals used in FIGS. 1 to 5, and corresponding but modified elements are designated by the same reference numerals primed.

Whereas the device 30 is attached to the toilet seat 18, the device 30' is attached to the rim of the toilet bowl 14. The device 30' includes the green LED 38 for illuminating the interior of the bowl 14 as indicated by rays 32'.

The device 30' includes the sensor switch 36 which in this embodiment is actuated by the seat 18. More specifically, when the seat 18 is up, it is disengaged from the switch 36, the device 30' is activated, and the LED 38 illuminates the bowl 14. The annunciator unit 48 is also activated in the manner described above with reference to FIGS. 1 to 5. When the seat 18 is down, it engages with and depresses the plunger **36*a* of the switch 36 to de-activate the device 30'**.

The device 30' can be attached to the rim of the bowl 14 using any suitable means. For example, as viewed in FIG. 7, a generally U-shaped mounting bracket 60 is attached to the bowl 14 by velcro strips 62. The device 30' is attached to the bracket 60 by velcro strips 64. The strips 64 enable the device 30' to be mounted at a variable height such that the switch 36 can be optimally actuated by the seat 18 when it is moved to the lower position.

Figure 9:
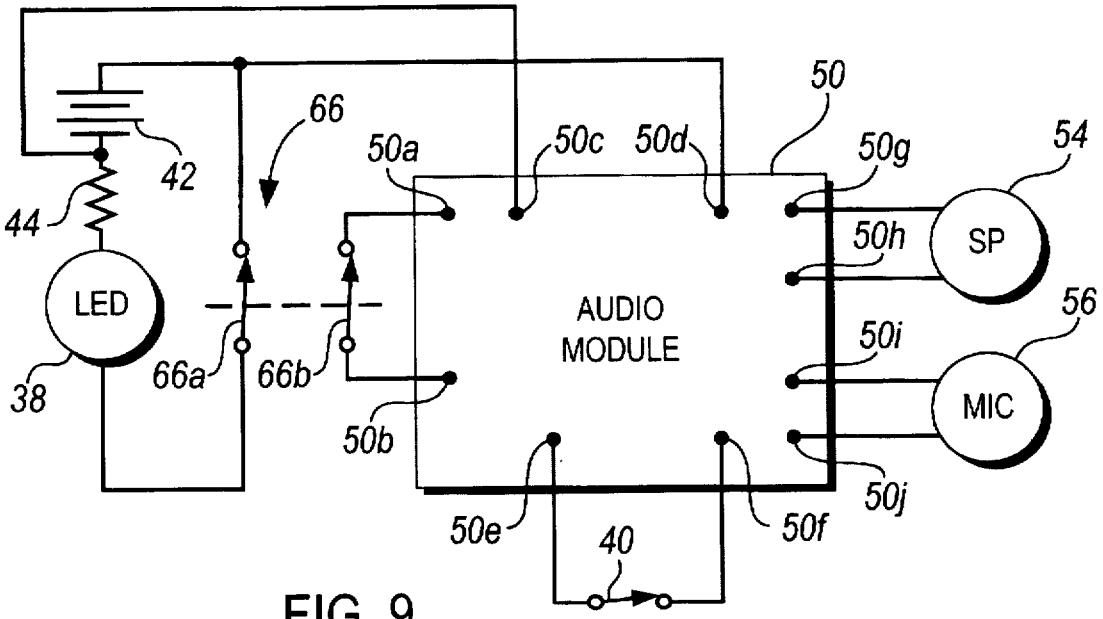
FIGS. 9 and 10 are electrical schematic diagrams illustrating various modifications to the devices of FIGS. 1 and 6.

FIG. 9 illustrates a modified electrical configuration which is applicable to either of the devices 30 and 30'. In this case, the switch 36 is replaced by a double tandem switch 66 having a first section **66*a* which performs the function of the switch 36, and a second section 66*b* which connects or disconnects the ON/OFF terminals of the module 50**.

The sections **66*a* and 66*b* are both normally closed, and are opened together by depression of a single plunger which corresponds to the plunger 36*a* of the switch 36. This configuration provides electrical isolation of the control functionality of the illumination unit 46 and the annunciator unit 48. Another modification which is illustrated in FIG. 9 is that the LED 38 and the module 50 are powered by a single battery 68**.

Figure 10:
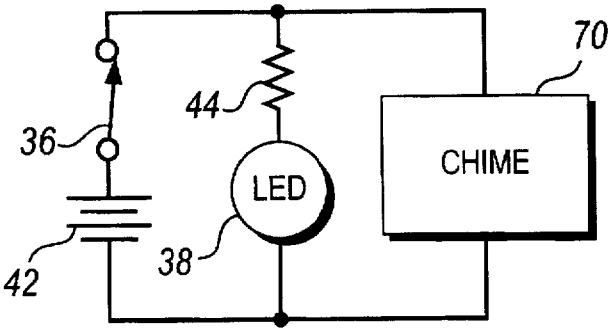

FIG. 10 illustrates a simplified electrical configuration in which the audio module 50 is replaced by a simple chime 70 which is connected in series with the LED 38 and audibly annunciates continuously as long as the switch 36 is closed. The chime 70 can be configured to produce any suitable sound, can be replaced by a bell, buzzer, whistle, or any other sound emitting component. Another alternative, the chime 70 can be replaced by a playback-only audio module which is hard-wired to generate an unalterable verbal message or musical sequence.

In summary, the present invention provides an illumination and annunciator device for a toilet bowl which overcomes the drawbacks of the prior art by prompting a user to replace the toilet seat in the lower position after performing standing urination.

Various modifications will become possible for those skilled in the art after receiving the teachings of the present disclosure without departing from the scope thereof.

For example, the batteries of the illustrated embodiments can be replaced by an A.C. to D.C. converter which plugs into a wall socket remote from the toilet, is connected to the device by a waterproof cable, and supplies a D.C. voltage for powering the illumination and annunciator units. The D.C. voltage and current are selected to be sufficiently low that no safety hazard will exist even if the device is completely submerged in water.

I claim:

1. An illuminating and annunciating device for a toilet having a bowl, and a seat which is movable between a lower seating position and an upper retracted position, the device comprising:

an illumination unit for illuminating the bowl;

an annunciator unit for generating an audible indication which reminds a user to move the seat from the retracted position to the seating position after use; and a sensor for activating the illumination unit and the annunciator unit when the seat is in the retracted position; and de-activating the illumination unit and the annunciator unit when the seat is in the seating position;

in which the annunciator unit comprises an audio module for playing back said audible indication as a recorded audio sequence; and the audio module is configured to selectively record an audio sequence.

2. A device as in claim 1, in which the annunciator unit generates said audible indication continuously while the seat is in the retracted position.

3. A device as in claim 1, in which the annunciator unit further comprises a switch for switching the audio module between a record mode and a playback mode.

4. A device as in claim 1, in which the annunciator unit generates said audible indication for a predetermined length of time after the seat is moved from the seating position to the retracted position.

5. A device as in claim 4, in which said predetermined length of time is at least 20 seconds.

6. A device as in claim 1, further comprising:

a casing for housing the illumination unit, the annunciator unit, and the sensor;

in which the illumination unit comprises a lamp which protrudes from the casing.

7. A device as in claim 6, in which:

the casing is configured to be attached to the bowl; and the sensor comprises a switch which protrudes from the casing and is actuated by engagement with the seat to de-activate the illumination unit and the annunciator unit when the seat is in the seating position; and is not actuated by engagement with the seat to activate the illumination unit and the annunciator unit when the seat is in the retracted position.

8. A device as in claim 6, in which:

the casing is configured to be attached to the seat; and the sensor comprises a switch which protrudes from the casing and is actuated by engagement with the bowl to de-activate the illumination unit and the annunciator unit when the seat is in the seating position; and is not actuated by engagement with the bowl to activate the illumination unit and the annunciator unit when the seat is in the retracted position.

9. A device as in claim 6, in which the casing is liquid resistantly sealed.

10. A device as in claim 1, in which the audio module has a capacity for recording an audio sequence having a predetermined maximum time length.

11. A device as in claim 10, in which said predetermined maximum time length is at least 20 seconds.

12. A device as in claim 10, in which the audio module is configured to play back said recorded audio sequence once.

13. A device as in claim 10, in which the audio module is configured to play back said recorded audio sequence repeatedly.

14. A device as in claim 1, further comprising at least one battery for powering the illumination unit and the annunciator unit.

15. A device as in claim 14, in which said at least one battery comprises:

a first battery for powering the illumination unit; and a second battery for powering the annunciator unit.

16. An illuminating and annunciating device for a toilet having a bowl, and a seat which is movable between a lower seating position and an upper retracted position, the device comprising:

an illumination unit for illuminating the bowl;

an annunciator unit for generating an audible indication which reminds a user to move the seat from the retracted position to the seating position after use; and a sensor for activating the illumination unit and the annunciator unit when the seat is in the retracted position; and de-activating the illumination unit and the annunciator unit when the seat is in the seating position;

in which the annunciator unit comprises an audio module for playing back said audible indication as a recorded audio sequence;

the audio module is configured to selectively record an audio sequence; and the annunciator unit further comprises a microphone and a speaker which are operatively connected to the audio module for respectively recording and playing back an audio sequence.

* * * * *